US011842587B1

(12) United States Patent
Müller et al.

(10) Patent No.: US 11,842,587 B1
(45) Date of Patent: Dec. 12, 2023

(54) SYSTEM, COMPRISING A LOCK UNIT FOR A CABINET AND AT LEAST ONE PORTABLE USER TERMINAL

(71) Applicant: rapitag GmbH, Munich (DE)

(72) Inventors: Sebastian Müller, Munich (DE); Alexander Schneider, Munich (DE)

(73) Assignee: RAPITAG GMBH, Munich (DE)

( * ) Notice: Subject to any disclaimer, the term of this patent is extended or adjusted under 35 U.S.C. 154(b) by 0 days.

(21) Appl. No.: 17/887,843

(22) Filed: Aug. 15, 2022

(51) Int. Cl.
*G07C 9/00* (2020.01)

(52) U.S. Cl.
CPC ..... *G07C 9/00309* (2013.01); *G07C 9/00896* (2013.01); *G07C 2009/00388* (2013.01); *G07C 2009/00412* (2013.01)

(58) Field of Classification Search
None
See application file for complete search history.

(56) References Cited

U.S. PATENT DOCUMENTS

2016/0097220 A1* 4/2016 Woodling ..... E05B 47/0673 70/278.7

* cited by examiner

*Primary Examiner* — K. Wong
(74) *Attorney, Agent, or Firm* — Kilpatrick Townsend & Stockton LLP

(57) ABSTRACT

The present invention relates to a system, comprising a lock unit for a cabinet and at least one portable user terminal, the at least one user terminal comprising an interface unit for receiving input commands by the user, a communication unit for at least wirelessly transmitting a release command to the lock unit, and a control unit operatively coupled with the interface unit, the communication unit and a storage unit, wherein the storage unit is adapted to store a unique identifier of the user terminal, wherein the control unit is adapted to create the release command based on input commands in such a manner that it includes the unique identifier; the lock unit comprising a plug unit which is adapted to be transferable between a release position and a locking position, wherein in the release position, opening of the cabinet is enabled, and in the locking position, opening of the cabinet is prohibited, an operation unit adapted for manual operation by the user, which is adapted to transfer the plug unit from its release position to its locking position, an actuation unit adapted for automatically transferring the plug unit from its locking position to its release position, a communication unit for wirelessly receiving the release command from the user terminal; and a control unit operatively coupled to the communication unit and the actuation unit and adapted to verify the received release command as well as to control the actuation unit for transferring the plug unit to its release position upon having verified the received release command, wherein the control unit of the lock unit is further adapted to store status and/or use data on the received release command and/or to transmit status and/or use data to an external server by means of the communication unit of the lock unit.

15 Claims, 3 Drawing Sheets

Figure 1:
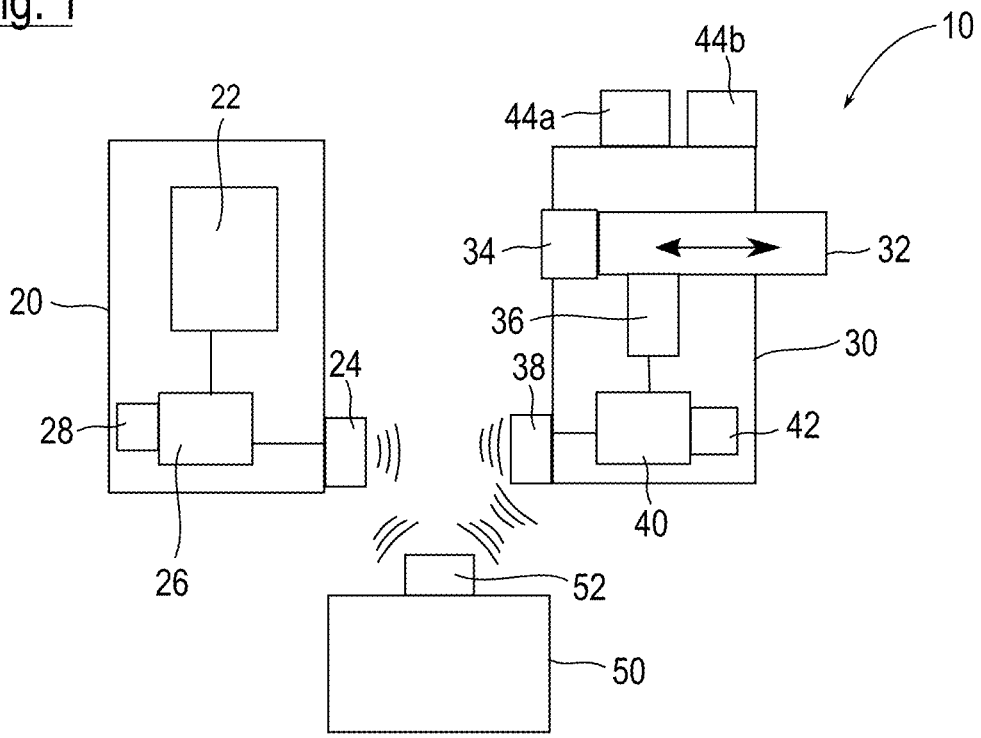

SYSTEM, COMPRISING A LOCK UNIT FOR A CABINET AND AT LEAST ONE PORTABLE USER TERMINAL

The present invention relates to a system, comprising a lock unit for a cabinet and at least one portable user terminal, an assembly comprising such a system and a cabinet, a method for operating such a system and a computer-readable medium having stored thereon code for performing such a method.

Recently, in retail stores more and more items have been presented in lockable cabinets, which typically comprise transparent panels to protect the items from theft on the one hand and to present them in an attractive manner to potential customers on the other hand. This locking away of items in dedicated cabinets is considered an improvement in anti-theft protection due to the fact that anti-theft devices directly applied to such items can more easily be removed from retail stores together with the item, such that theft is discouraged but not prevented. In particular, organized retail crime has become a big problem, and it has been observed that thieves have started to steal items provided with anti-theft devices from stores in order to break said devices open at a later time outside the respective stores. Typical items that have been protected from theft by placing them in lockable cabinets comprise alcoholic beverages and expensive electronic equipment, both of which have sizes and retail prices that make it relatively easy yet profitable to steal them from a store.

Cabinets typically used for such purposes may comprise drawers and lockers and in general any physically lockable receptacle, in which items can be housed in a store. However, it has been found that such cabinets tend to "hide" the items from potential customers even if they are visible through transparent panels, since it can be cumbersome to find a store employee having a key for the respective lock of the cabinet, such that the customer may be hesitant or discouraged to buy items locked in such cabinets. In particular, not every employee in a given store may carry their own key and/or may be entitled to open the respective cabinets such that even if a potential customer was to find a store employee this does not necessarily mean the he or she may in fact open the cabinet in question at this given time.

Furthermore, on the store owner side of things, in case such a key for a cabinet housing expensive items gets lost or stolen, all physical locks in the store which may be opened by said key would have to be changed as a precautionary measure. Not only does this lead to inacceptable costs for the store owner, but it may take a substantial amount of time for obtaining suitable locks and keys and to reinstall them.

Lock-and-key systems currently used for such purposes usually comprise a lock unit with a core section, in which the key is inserted in order to open the lock unit. In case the key fits to the lock, the entire core can be removed from the lock housing together with the key. As long as the core is located within the housing, it prevents an opening of the cabinet and for example a relative movement between two door panels or opening of a drawer. Once the core is removed from the housing, a relative movement between the doors or a sliding of the drawer and as such an opening of the cabinet becomes possible. It is traditionally not possible to monitor in an automated manner whether such a lock is locked at a given time, who has opened and closed the lock in the past or the amount of time a lock has been open in a given timeframe, etc.

There is therefore a demand for an improved locking system for cabinets of the above-described type, which not only provides for securely storing items in a store environment but also provides improved functionalities and facilitates improved handling thereof by store employees as well as allows for keeping track of use patterns of the system.

For this purpose, the present invention proposes a system, comprising a lock unit for a cabinet and at least one portable user terminal, the at least one user terminal comprising an interface unit for receiving input comments by the user, a communication unit for at least wirelessly transmitting a release command to the lock unit, and a control unit operatively coupled with the interface unit, the communication unit and a storage unit, wherein the storage unit is adapted to store a unique identifier of the user terminal, and wherein the control unit is adapted to create the release command based on input commands in such a manner that it includes the unique identifier. On the other hand, the lock unit comprises a plug unit, which is adapted to be transferrable between a release position and a locking position, wherein in the release position, opening of the cabinet is enabled and in the locking position, opening of the cabinet is prohibited, an operation unit adapted for manual operation by the user, which is adapted to transfer the plug unit from its release position to its locking position, an actuation unit adapted for automatically transferring the plug unit from its locking position to its release position, a communication unit for wirelessly receiving the release command from the user terminal, and a control unit operatively coupled to the communication unit and the actuation unit and adapted to verify the received release command as well as to control the actuation unit for transferring the plug unit to its release position upon having verified the received release command, wherein the control unit of the lock unit is further adapted to store status and/or use data on the received release command and/or to transmit status and/or use data on the received release command to an external server by means of the communication unit of the lock unit.

Thus, in the system according to the present invention, not only is a portable user terminal, such as for example a smartphone with a dedicated software application running thereon or a dedicated portable unit with corresponding communication capabilities, provided for triggering a transfer of the plug unit to its release position, but also the control unit of the lock unit stores or provides status and/or use data on the received release command in such a manner that it can be further processed at any given time. It shall at this point be mentioned that the transfer of the plug unit triggered by the release command and performed by the actuation unit may further necessitate a manual operation by the user such that for example the actuation unit may release a blocking member which then allows for a manual movement of the plug unit into its release position which is blocked when the release command has not been received.

By relying on known communication protocols, such as for example NFC or Bluetooth, suitable user terminals can be readily provided or existing user terminals such as smartphones can easily be adapted for the purpose of serving as portable user terminal in the system according to the present invention. In particular, a plurality of portable user terminals can be assigned to a single lock unit such that in the example given above, a plurality of store employees can open a given lock in a retail store at any given time without first searching for a physical key. Furthermore, losing or breaking a key in such locks is also prevented by using portable user terminals for unlocking the corresponding lock units while the fact that by means of the operation unit any user can manually transfer the plug unit from its release position to its locking position, even without having a portable user terminal at hand, the person in question can in any case secure the items inside the cabinet.

Another aspect of keeping track of the status and/or use data concerning the received release commands by the control unit of the lock unit is that permissions for certain portable user terminals and corresponding users associated with said portable user terminals can easily be changed, such that the system according to the present invention is much more flexible than known locking systems used previously.

In certain embodiments, the operation unit of the lock unit may be adapted for a pressing or turning operation by the user, such that the transfer of the plug unit from its release position to its locking position can be performed in an easy and intuitive manner.

As already briefly mentioned above, the control unit of the lock unit may further be adapted to receive configuration commands by means of the communication unit of the lock unit. In this way, permissions for opening a certain cabinet may be adjusted in real time and for example any store employee may on any working day only be granted permission to open cabinets in the department of a store for which he or she is assigned for the given day.

Furthermore, the control unit of the lock unit may also be adapted to issue an alarm after the plug unit has been in its release position for a predetermined amount of time, such as for example five minutes. By providing this additional functionality, situations can be avoided in which the lock unit is put into its release position and the corresponding user forgets to subsequently operate the operation unit for re-locking the plug unit. Such an alarm may be issued by means of an optical or acoustic signaling unit provided at the lock unit, such as for example a speaker playing a sound or one or more LEDs giving an optical signal. Alternatively or in addition, a corresponding notification may be transmitted to the at least one portable user terminal, such that for example in the case of the use of mobile phones for this purpose, the corresponding user can be notified by means of a push notification or a similar alarm feature.

In another embodiment of the system according to the present invention, the actuation unit may also be capable of transferring the plug unit from its release position to its locking position. Thus, the transfer of the plug unit from its release position to its locking position may not only be performed by means of the operation unit, but also by means of providing a locking command to the control unit of the lock unit, which will subsequently control the actuation unit to transfer to plug unit into its locking position. Herein, the corresponding locking commands may be handled in a similar manner as the release commands discussed above, such that they may be requested at the same portable user terminals, include the same unique identifiers and have to be verified by the control unit of the lock unit before the actuation unit is controlled to transfer the plug unit to its locking position.

In such embodiments, the control unit may also be adapted to automatically control the actuation unit to transfer the plug unit to its locking position after the plug unit has been in its release position for a predetermined amount of time. Thus, in such embodiments, the lock unit will automatically be transferred into a locking configuration after a predetermined amount of time has lapsed since it has been transferred to its release configuration. In such cases, it may be beneficial if the control unit of the lock unit is provided with information on whether the corresponding cabinet is currently in a configuration in which locking thereof is possible at all, for example if two sliding doors are in a relative position with respect to one another in which their relative movement can be blocked by the lock unit or whether a drawer is closed and can thus be locked by a corresponding operation.

In any case, the transfer of the plug unit between its release position and its locking position may correspond to a linear or rotational movement, depending on the type and layout of the cabinet to be provided with the lock unit. For example in the case of a pair of sliding doors, if a relative movement between the two shall be prevented by the lock unit, a linear movement of the plug unit may be desired, while for locking drawers, a rotational movement of the plug unit may be advantageous.

According to another aspect, the present invention relates to an assembly comprising a system as just described as well as a cabinet, in which the lock unit is installed, wherein the cabinet comprises a door, which is movable between an open and a closed position and may be locked in its closed position by means of the lock unit. In this context, the term "door" may for example also relate to a drawer or a pair of sliding doors as described above, such that any movable component of the cabinet by means of which access to an interior space thereof in which items may be housed can be prohibited, is to be considered a door in the sense of the present invention.

In such assemblies, the lock unit may further be provided with a tampering sensor unit, which is adapted to issue an alarm upon detection of forceful removable of the lock unit from the cabinet. Such an alarm may also be directly issued at the lock unit, for example by means of a speaker or an optical alarm device, or it may be transferred to a portable user terminal, such that the corresponding user is informed about the tampering with the lock unit in real time and can take suitable counter-measures.

Also, the assembly according to the present invention may further comprise a sensor unit for determining whether the door of the cabinet is in its closed position, which may be especially beneficial in the above-described embodiments, in which an automatic control of the actuation unit to transfer the plug unit to its locking position is performed after the plug unit has been in its release position for a predetermined amount of time.

According to another aspect of the present invention, a method is provided for operating a system as described above, comprising the steps of receiving the user input command at the interface unit of the user terminal, creating a release command at the control unit of the user terminal, transmitting the release command by the communication unit of the user terminal, receiving the release command at the communication unit of the lock unit, verifying the release command at the control unit of the lock unit, upon verification of the release command, controlling the actuation unit to transfer the plug unit into its release position, and storing status and/or use data on the received release command by the control unit of the lock unit and/or transmitting status and/or use data to an external server.

Herein, for improved security of the method and system, the creating of the lock command may comprise an encryption step and the verification of the release command may comprise a decryption step. For this purpose, known decryption/encryption techniques may be performed by the portable user terminal and lock unit, respectively, while the thus provided release command will also include the unique identifier of the portable user terminal for further bookkeeping and data analysis capabilities.

Furthermore, the method according to the present invention may comprise a step of configuring the verification step based on configuration commands received by means of the communication unit of the lock unit by the control unit of the lock unit. For this purpose, a dedicated configuration terminal, an external server may or any portable user terminal on which super-user rights have been granted for the respective user may be used for configuring the verification step, for example granting permission to a new user to unlock the lock unit.

The status and/or use data already mentioned above may in particular comprise information on the user terminal transmitting the release command and/or the amount of time the plug unit has been in its release position. Thus, it can be evaluated which user has had access to the cabinet in question and for what period of time, which allows for high-level data analysis on use patterns by the store owner or any other entity provided with corresponding access to the relevant collected data sets.

Lastly, the present invention relates to a computer-readable medium, having stored thereon code, which, when executed by the control unit of the user terminal and/or the control unit of the lock unit of a system according to the invention, performs a method as described above.

Figure 2:
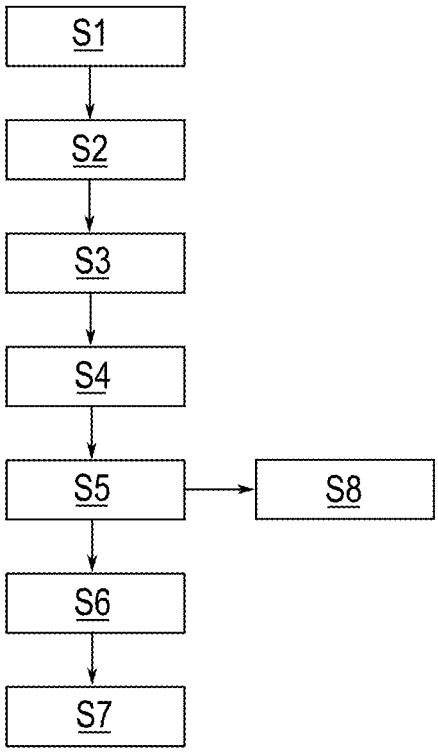
Figure 3:
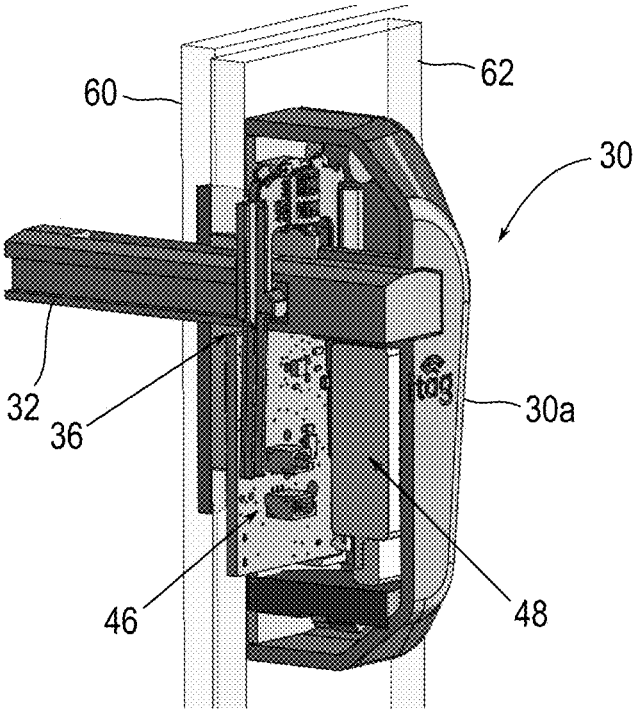
Figure 4:
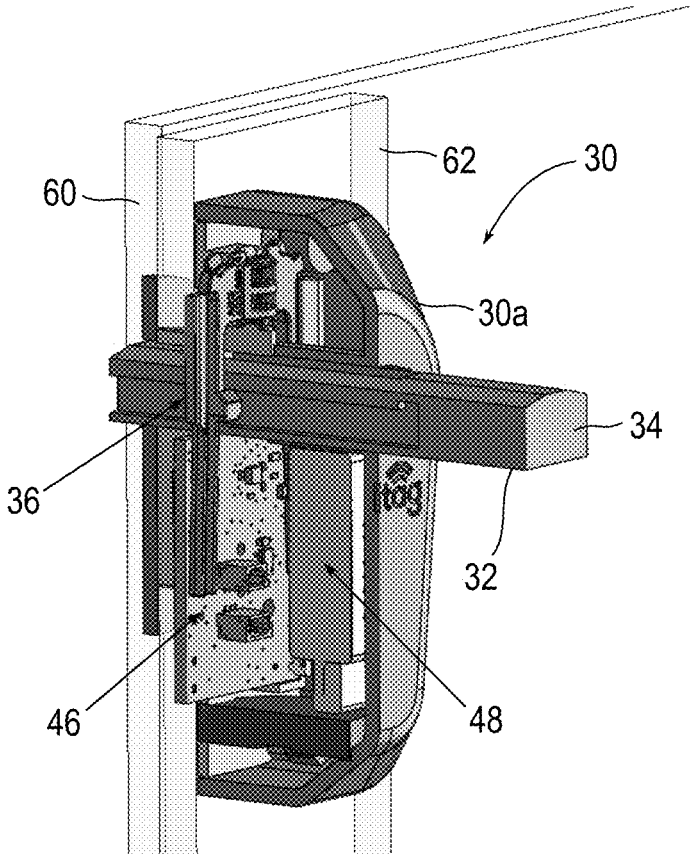
Figure 5:
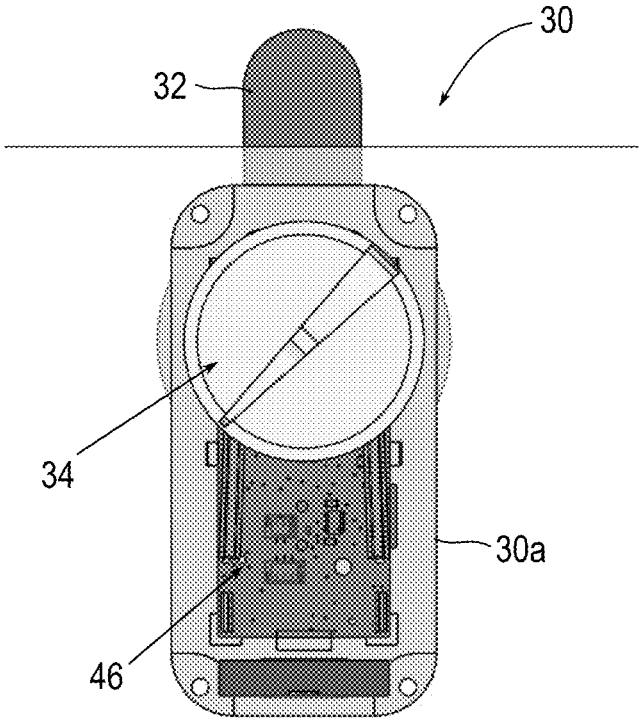
Figure 6:
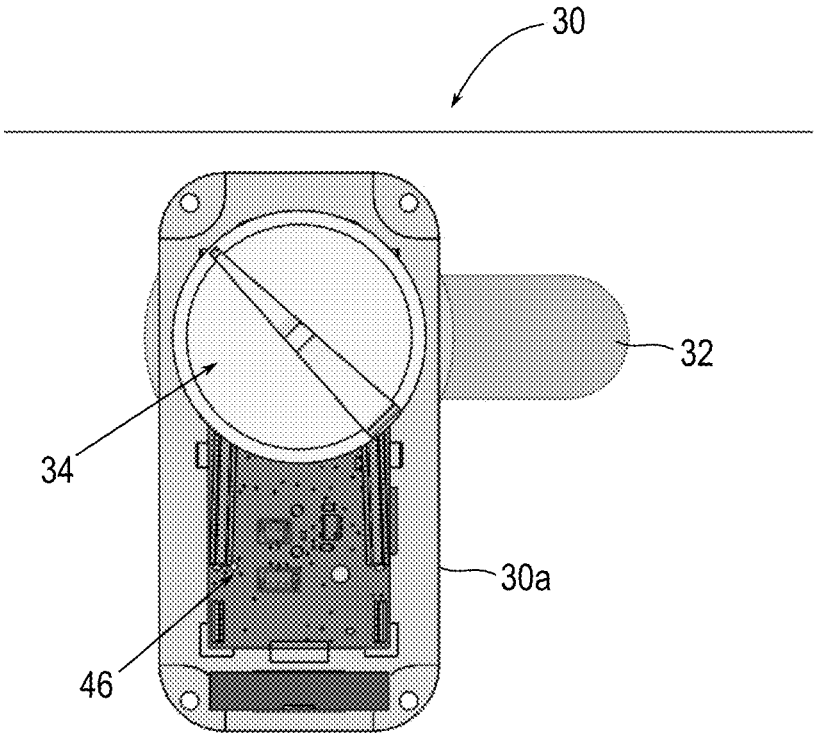

Further features and advantages of the present invention will become even clearer from the following description of embodiments thereof, when taken together with the attached drawings. Said drawings show in particular:

FIG. 1 a schematic block diagram of a system according to the present invention;

FIG. 2 a flow chart representing a method according to the present invention;

FIG. 3 a first embodiment of a lock unit of a system according to the present invention in a first state;

FIG. 4 the lock unit of FIG. 3 in a second state;

FIG. 5 a second embodiment of a lock unit of a system according to the present invention in a first state; and FIG. 6 the lock unit of FIG. 5 in a second state.

In FIG. 1, a schematic block diagram of a system according to the present invention is shown and generally denoted with the reference numeral 10.

The system 10 comprises a portable user terminal 20, such as a smartphone running a software application capable of performing certain steps of a method according to the present application, or a dedicated portable user terminal which is especially designed for forming a part of the system 10. It shall already at this be noted that the system 10 my comprise an arbitrary number of user terminals 20, which may all be of an identical type or of at least two different types. In particular if smartphones are used for this purpose, by providing a suitable software application which may be run on different types of smartphones, the present system 10 becomes highly flexible and user-friendly.

The user terminal 20 comprises an interface unit 22, by means of which a user may input commands, wherein in the case of a smartphone typically a touchscreen will form the interface unit 22, while in the case of a dedicated portable user terminal any known kind of software or hardware buttons or similar units may be provided for allowing the user of the device to enter an input command.

Furthermore, the user terminal 20 comprises a communication unit 24 as well as a control unit 26 having access to a storage unit 28. Therein, the control unit 26 may be formed by any sort of suitable microprocessor or similar electronic unit and it is operatively coupled to both the interface unit 22 for receiving user input commands as well as to the communication unit 24 for communicating with outside devices such as the lock unit 30 and the external server 50 described below. In particular, the control unit 26 in a user terminal 20 of a system 10 according to the present invention is adapted to create a release command for the lock unit 30 based on input commands entered by a user by means of the interface unit 22 as well as a unique identifier of the terminal 20 stored in the storage unit 28.

For this purpose, different known algorithms may be employed for creating such a release command comprising the unique identifier of the terminal 20, including an encoding thereof for security reasons, such that the ensuing release command can subsequently be transmitted by the terminal 20 by means of its communication unit 24. For this purpose, any kind of known or proprietary communication protocol may be used, including NFC and Bluetooth for short range communication.

The lock unit 30 already briefly mentioned above is in turn provided to lock a cabinet and for this purpose comprises a plug unit 32 which is adapted to be transferable between a release position in which it is possible to open the cabinet provided with the lock unit 30 and a locking position in which it is prohibited to open the cabinet. In the embodiment shown in FIG. 1, the plug unit 32 is adapted to be transferable between its release and locking positions by means of a linear movement as indicated by the respective arrow, yet there are also embodiments of the present invention conceivable in which the transfer of a similar plug unit 32 is performed by means of a rotational movement. One such embodiment will be discussed further below with respect to FIGS. 5 and 6.

The lock unit 30 also comprises an operation unit 34 which is adapted for manual operation by the user in order to transfer the plug unit 32 from its release position to its locking position. Therefore, even if a given user is not in possession of the terminal 20 discussed above, it will always be possible to transfer the plug unit 32 into its locking position. In the embodiment shown in FIG. 1, the operation unit 34 may for example be adapted for a pushing operation and may actually be formed integrally with the plug unit 32, such that the user in question may directly act on the plug unit 32 to physically move it into its locking position. However, in alternative embodiments, the operation unit 34 may also comprise electrical and/or electronic means, such that upon operation of the operation unit 34, the plug unit 32 will be transferred into its locking position by means of an actuator device.

For a similar purpose, the lock unit 30 comprises an actuation unit 36 for automatically transferring the plug unit 32 from its locking position into its release position in order to facilitate opening of the corresponding cabinet. Said actuation unit may for example be an electrical linear actuator. In another embodiment, the actuation unit 36 might for example also be embodied by a pre-loaded mechanical spring and a controllable retention element, such that upon a suitable control of the retention element, it moves out of contact with the plug unit 32 and the mechanical spring will then push the plug unit 32 into its release position.

For receiving release commands issued by the user terminal 20, the lock unit 30 in a similar manner comprises a communication unit 38 and a control unit 40 provided with a memory unit 42. Said control unit 40 is operatively coupled to both the communication unit 38 and the actuation unit 36 and adapted to verify any release command received by the communication unit 38. For this purpose, different algorithms may be used be the control unit 40, such as decryption methods, and the verification of the release commands may include a check of whether the particular user terminal 20 currently has permission to release the lock unit 30. Suitable configuration items may be stored in the storage unit 42 and may for example comprise a list of unique identifiers of user terminals 20 which have permission to transfer the lock unit 30 into its release state.

Furthermore, the control unit 40 is adapted to store status and/or use data in the received release commands in the storage unit 42 for further reading it out and/or to transmit said status and/or use data to an external server 50 by means of its communication unit 38. Said external server 50 is similarly equipped with a communication unit 52 and may be adapted to keep track of all status and/or use data of a plurality of lock units 30. Data collected in such a manner may be stored for a given time span and any sort of data analysis may be performed thereon, for example in order to evaluate use patterns of the user terminal 20. Furthermore, the external server 50 may also be adapted to transmit configuration commands to the lock unit via the two communication units 52 and 38 in order to modify the configuration items stored in the storage unit 42 of the lock unit 30 mentioned above.

It shall also be noted that the lock unit 30 is further provided with a tampering sensor unit 44*a* which is adapted to issue an alarm upon detection of forceful removal of the lock unit 30 from the cabinet as well as with a further sensor unit 44*b* which is adapted to check whether the respective door of the cabinet in question is currently in its closed position. It shall also be pointed out that the system 10 comprising at least the user terminal 20 and the lock unit 30 together with a cabinet to which the lock unit 30 form an assembly according to the present invention. Therein, the cabinet comprises at least one door, which is movable between an open and a closed position and may be locked in its closed position by means of the lock unit 30. In such assemblies, the sensor unit 44*b* for determining whether the door of the cabinet is in its closed position may for example detect the proximity of an detection element provided at a certain position on the housing of the cabinet in the closed position of the respective door.

Now with reference to the flow chart of FIG. 2, a method according to the present invention is illustrated, which may be performed by the system 10 shown in FIG. 1. Said method at step S1 comprises receiving a user input command at the interface unit 22 of the user terminal 20, wherein for example the user may choose the lock unit 30 to be released from a list of lock units 30 on the touchscreen of a smartphone acting as the user terminal 20.

The control unit 26 of the user terminal 20 at step S2 then creates a release command based on said user input in such a manner that it includes the unique identifier of the user terminal 20 stored in its storage unit 28, for example using a suitable encryption algorithm. The release command thus created is then transmitted by the communication unit 24 of the user terminal 20 to the lock unit 30 at step S3.

At step S4, the release command is received at the communication unit 38 of the lock unit 30 and forwarded to the control unit 40 of the lock unit 30, which at step S5 verifies said release command, for example with respect to whether the user terminal 20 currently has permission to release the lock unit 30 based on configuration items stored in its storage unit 42. For this purpose, a suitable decryption algorithm may be used and the unique identifier of the user terminal 20 may be extracted from the transmitted and received release command.

In case the release command is in fact verified in step S5, the method proceeds to step S6, in which the actuation unit 36 is controlled to transfer the plug unit 32 into its release position, while subsequently or concurrently, in step S7, status and/or use data on the received release command are stored by the control unit 40 of the lock unit 30 and/or transmitted to the external server 50.

If, on the other hand, the verification of the release command in step S5 fails, for example because the user terminal 20 that issued said release command currently does not have permission to release the lock unit 30, the method proceeds to step S8, in which either the received release command my simply be discarded or a warning about an unauthorized attempt to release the lock unit 30 may be issued, for example to the external server 50, which may also keep track of such unsuccessful attempts of releasing the lock unit 30.

In FIGS. 3 and 4 as well as 5 and 6, respectively, two possible embodiments of lock units 30 with respective housings 30*a* of a system 10 of FIG. 1 are shown each in a locking configuration and a release configuration. The main difference between the two embodiments is that in the first embodiment of FIGS. 3 and 4 comprises a plug unit 32 adapted for linear movement between its respective locking and release positions, while the second embodiment of FIGS. 5 and 6 comprises a plug unit 32 adapted for rotational movement between the two positions. Thus, the respective components of the two lock units 30 not directly contributing to the movement of the respective plug units 32, such as their communication units 38 and control units 40, can be built similarly and it is referred to the general description of such components given above in the context of FIG. 1. Said components are integrated on a respective circuit board 46 which may further include additional components such as the sensor units 44*a* and 44*b* mentioned above, and it shall also be pointed out that in FIGS. 3 and 4, a battery unit 46 is visible, which powers at least the actuation unit 36, the control unit 40 as well as the communication unit 38.

In both embodiments, the transfer of the respective plug units 32 from their locking positions in FIGS. 3 and 5 to their release positions shown in FIGS. 4 and 6 is driven by actuation units 36 while the operation units 34 for manually transferring the plug units 32 from their release positions to their locking positions are formed such that a user may directly press or turn the plug units 32 by means of a pushing surface provided on the plug unit 32 in the first embodiment or a rotary knob connected to the plug unit 32 in the second embodiment.

It shall at this point also be pointed out that in FIGS. 3 and 4, two sliding doors 60 and 62 of a cabinet are shown which cannot be slid with respect to one another in the configuration of FIG. 3 in which the plug unit 32 of the lock unit 30 is in its locking position while in FIG. 4 with the plug unit 32 in its release position, one door may be slid with respect to the other one. In contrast, the second embodiment of FIGS. 5 and 6 with its rotary plug unit 32 is in particular suitable to lock and release drawers in a respective cabinet.

The invention claimed is:

1. System, comprising a lock unit for a cabinet and at least one portable user terminal, the at least one user terminal comprising:

an interface unit for receiving input commands by the user;

a communication unit for at least wirelessly transmitting a release command to the lock unit; and a control unit operatively coupled with the interface unit, the communication unit and a storage unit, wherein the storage unit is adapted to store a unique identifier of the user terminal, wherein the control unit is adapted to create the release command based on input commands in such a manner that it includes the unique identifier; the lock unit comprising:

a plug unit which is adapted to be transferable between a release position and a locking position, wherein in the release position, opening of the cabinet is enabled, and in the locking position, opening of the cabinet is prohibited;

an operation unit adapted for manual operation by the user, which is adapted to transfer the plug unit from its release position to its locking position;

an actuation unit adapted for automatically transferring the plug unit from its locking position to its release position;

a communication unit for wirelessly receiving the release command from the user terminal; and a control unit operatively coupled to the communication unit and the actuation unit and adapted to verify the received release command as well as to control the actuation unit for transferring the plug unit to its release position upon having verified the received release command, wherein the control unit of the lock unit is further adapted to store status and/or use data on the received release command and/or to transmit status and/or use data to an external server by means of the communication unit of the lock unit.

2. System according to claim 1, wherein the operation unit is adapted for a pressing or turning operation by the user.

3. System according to claim 1, wherein the control unit of the lock unit is further adapted to receive configuration commands by means of the communication unit of the lock unit.

4. System according to claim 1, wherein the control unit of the lock unit is further adapted to issue an alarm after the plug unit has been in its release position for a predetermined amount of time.

5. System according to claim 1, wherein the actuation unit is also capable of transferring the plug unit from its release position to its locking position.

6. System according to claim 5, wherein the control unit of the lock unit is further adapted to automatically control the actuation unit to transfer the plug unit to its locking position after the plug unit has been in its release position for a predetermined amount of time.

7. System according to claim 1, wherein the transfer of the plug unit between its release position and its locking position corresponds to a linear or rotational movement.

8. Assembly, comprising a system according to claim 1 and a cabinet, in which the lock unit is installed, wherein the cabinet comprises a door, which is movable between an open and a closed position and may be locked in its closed position by means of the lock unit.

9. Assembly according to claim 8, wherein the lock unit is further provided with a tampering sensor unit which is adapted to issue an alarm upon detection of forceful removal of the lock unit from the cabinet.

10. Assembly according to claim 8, further comprising a sensor unit for determining whether the door of the cabinet is in its closed position.

11. Method for operating a system according to claim 1, comprising the following steps:

receiving a user input command at the interface unit of the user terminal;

creating a release command at the control unit of the user terminal;

transmitting the release command by the communication unit of the user terminal;

receiving the release command at the communication unit of the lock unit;

verifying the release command at the control unit of the lock unit;

upon verification of the release command, controlling the actuation unit to transfer the plug unit into its release position; and storing status and/or use data on the received release command by the control unit of the lock unit and/or transmitting status and/or use data to an external server.

12. Method according to claim 11, wherein the creating of the release command comprises an encryption step and the verification of the release command comprises a decryption step.

13. Method according to claim 11, further comprising the following step performed by the control unit of the lock unit:

configuring the verification step based on configuration commands received by means of the communication unit of the lock unit.

14. Method according to claim 11, wherein the status and/or use data comprises information on the user terminal transmitting the release command and/or the amount of time the plug unit has been in its release position.

15. Non-transitory computer-read medium, having stored thereon code which when executed by the control unit of the user terminal and/or the control unit of the lock unit of a system according to claim 1 performs a method according to claim 11.

* * * * *